US005800288A

United States Patent [19]

Mims

[11] Patent Number: 5,800,288

[45] Date of Patent: Sep. 1, 1998

[54] BALL TOSS SPORT TRAINING APPARATUS

[76] Inventor: Calvin Mims, 709 N. Cuyler, Oak Park, Ill. 60302

[21] Appl. No.: 822,875

[22] Filed: Mar. 24, 1997

[51] Int. Cl.[6] ..... A63B 69/40

[52] U.S. Cl. ..... 473/417; 124/16; 273/129 S

[58] Field of Search ..... 124/16, 52; 473/422; 273/108.31, 108.55

[56] References Cited

U.S. PATENT DOCUMENTS

| | | | |
|---|---|---|---|
| 2,170,373 | 8/1939 | Kind | 273/129 AP |
| 2,664,077 | 12/1953 | Moore | 124/16 |
| 2,891,795 | 6/1959 | Glintz | 124/16 |
| 3,949,518 | 4/1976 | Lenza | 124/16 |
| 5,251,081 | 10/1993 | Rooks | 124/16 |
| 5,597,160 | 1/1997 | Mims | 124/16 |

*Primary Examiner*—Theatrice Brown

*Attorney, Agent, or Firm*—Robert G. Petrinec

[57] ABSTRACT

A sport training apparatus for projecting a ball into the air for training an athlete in the proper technique of hitting or catching the ball. The apparatus includes ball projecting means and a spring connected thereto for movement between a cocked state and an actuated state. The spring is held in the cocked state by a partial vacuum automatically developed within an air chamber which is created when a piston enters a cylinder. To cock the apparatus for use, the ball projecting means is pushed down which, in turn, causes the piston to enter the cylinder and create the air chamber. A check valve is connected to the air chamber to provide unrestricted air exit from the air chamber as the piston enters the cylinder. A pneumatic control release is connected to the air chamber for allowing ambient air to enter the air chamber for releasing some or all of the partial vacuum to actuate the spring thereby causing the ball projecting means to propel the ball into the air where it can be hit or caught by the athlete.

20 Claims, 5 Drawing Sheets

BALL TOSS SPORT TRAINING APPARATUS

BACKGROUND OF THE INVENTION

1. Field of the Invention

This invention relates generally to ball toss sport training apparatus which can be used for training individuals in particular techniques of a sport or athletic game.

In sports, hand-eye coordination is essential if athletes are to be successfully competitive in their chosen sport. While this is true in all sports it is particularly critical in sports that use a ball as the primary object of the sport. One such sport is baseball where a batter must hit a fast moving baseball. Here coaches spend a great deal of time teaching and demonstrating the proper technique of swinging a baseball bat to hit a pitched baseball. After the technique has been demonstrated, baseball players will spend a great deal of time practicing the technique to develop hand-eye coordination and the proper body movement to swing a baseball bat through the optimum arc to hit the baseball with maximum force. Repetitive practice requires substantial time, and because coaches are not always available or necessary during prolong practice sessions, batting training devices are often used by individuals to assist them in their batting practice. The importance of repetitive batting practice has encouraged the development of several forms of baseball batting training devices.

2. Brief Description of the Prior Art

Prior Art devices fall generally into two basic categories. The first category of Prior Art devices throw baseballs at high speed within the hitting zone of a waiting batter. These devices are often used for training young adults and professional baseball players to sharpen their batting skills. However, high speed throwing devices are cumbersome and complex to use as well as requiring substantial space for their use and storage. The second category of Prior Art devices are those which toss baseballs slowly into the hitting area of the batter either from an angled side position, or from near the ground and upward in front of the batter. It is this latter category of devices which the present invention relates and is a novel improvement over all Prior Art devices of this type.

Generally, these devices propel a baseball two to four feet upward in front of the batter. The upward movement of the baseball is at relatively slow speed to provide the batter with sufficient time to see the position of the baseball and swing the bat to hit the baseball. This action is repeated many times during the practice session to grove the batters swing by creating muscle memory. When in use it is common that batting training devices, and not the baseball, are struck with the baseball bat. Repeated inadvertent striking of Prior Art training devices has caused them to become inoperable thereby cutting short the training session. Because it is important that an individual repeat the swing movement many times, training apparatus must operate properly even after inadvertent striking by the baseball bat so that the practice session is not cut short. It is also important that new participants of the sport of baseball start their training with methods and devices which can be used throughout the year, either indoors or outdoors.

Prior art devices have been developed for this purpose and are disclosed in U.S. Pat. Nos. 1,826,641; 3,138,381; 3,139,700; 3,246,895; 3,446,199; 3,545,752; 3,612,027; 3,627,319; 3,792,861; 3,856,300; 4,129,110; 4,614,339; 4,865,318; 5,160,131; 5,221,081; 5,294,109 and 5,597,160. U.S. Pat. No. 5,597,160 was issued on Jan. 28, 1997 to applicant of this invention as an improvement over the known prior art, and the present invention is a further improvement over the prior art.

SUMMARY OF THE INVENTION

It is an object of this invention to provide a new and improved ball toss sport training apparatus for teaching the proper hand-eye coordination for hitting or catching a ball.

Another object of this invention is to provide a ball toss sport training apparatus which has a minimum number of moving parts and thereby is inexpensive to manufacture.

Another object of this invention is to provide a ball toss sport training apparatus which is compact in size and durable in construction and the movable components are subject to minimum wear for long life and low maintenance operation.

It is also an object of this invention to provide a ball toss sport training apparatus which can be used by individuals with or without the aid of an assistant or coach to actuate the device.

Still another object of this invention is to provide a ball toss sport training apparatus which can be used for propelling balls of different size and shape for training in different sports or athletic games.

A novel feature of this invention is the use of an air chamber wherein a negative pressure relative to ambient pressure, e.g., a partial vacuum, is created for holding the apparatus in a latched or cocked condition until sufficient air is controllably introduced back into the air chamber to eliminate the negative pressure and operate the apparatus.

Another feature of this invention is the use of pneumatic timing means to accurately control the time interval between the event of creating negative air pressure in an air chamber, e.g., cocking the device for use, and the event of releasing the negative air pressure from the air chamber, e.g., releasing the striker for impacting a baseball.

Still another feature of this invention is to provide a baseball batting training apparatus for projecting a baseball upward into the hitting zone of a batter and wherein a baseball bat is used to cock the apparatus for use.

Another feature of this invention is a multi-function, adjustable retainer cap threaded on the upper open end of the apparatus for selectively controlling the height of vertical travel of the baseball, for providing means for assembly and dis-assembly of the apparatus and for providing an aperture for supporting a baseball and through which the end of a baseball bat is inserted for cocking the apparatus for use.

An additional feature of this invention is the use of a remote control device operatively connected to an air chamber, which has a partial vacuum formed therein, for rapidly eliminating the partial vacuum and thereby provide substantially instantaneous operation of the apparatus.

BRIEF DESCRIPTION OF THE DRAWINGS

These and other objects, features and advantages of the present invention will be better understood from the following detailed description when taken in conjunction with the accompanying drawings, wherein.

DESCRIPTION OF THE PREFERRED EMBODIMENTS

Figure 1:
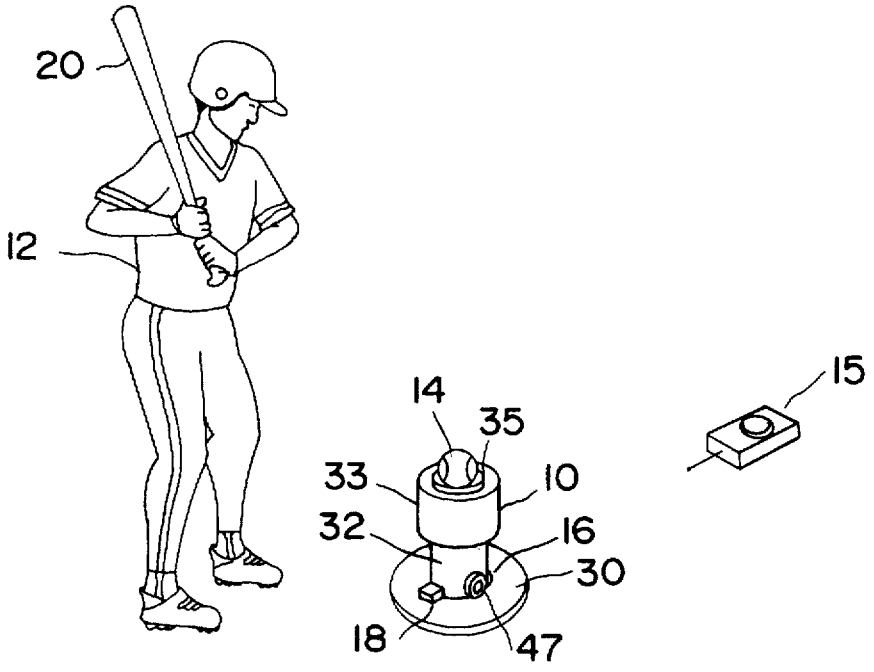
FIG. 1 illustrates the ball toss sport training apparatus of this invention with a remote control device, a baseball positioned at the upper end thereof and a batter standing adjacent the apparatus ready to hit the baseball.
Figure 2:
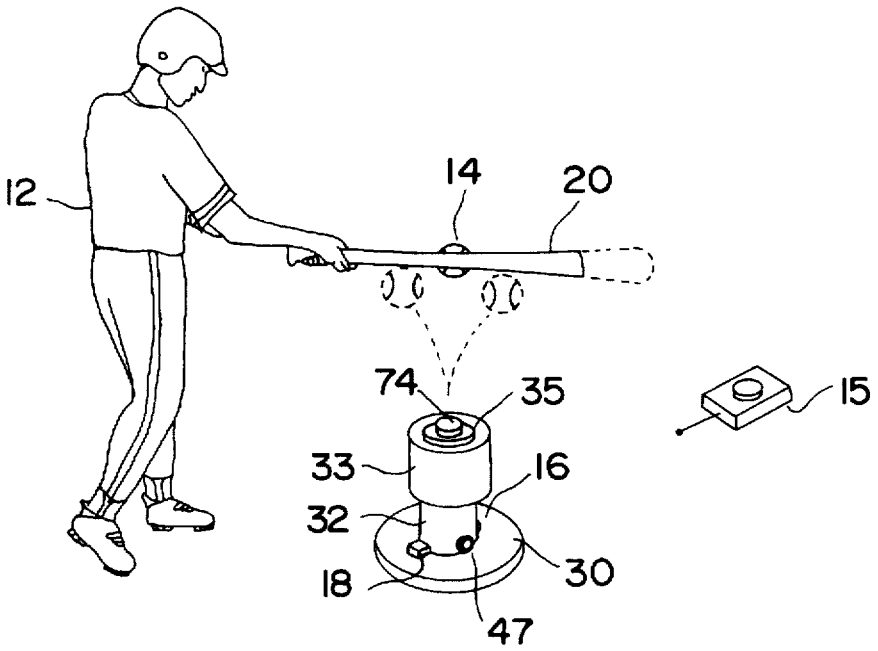
FIG. 2 illustrates the apparatus and batter of FIG. 1 showing the baseball after it has been propelled into the hitting zone of the batter and illustrates, in phantom line, baseball positions corresponding to inside and outside pitches.
Figure 3:
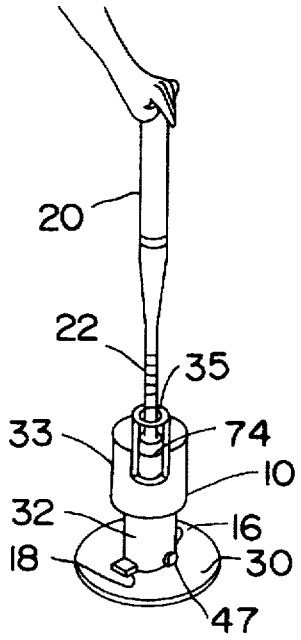
FIG. 3 illustrates a feature of the present invention which allows one end of a baseball bat to be inserted into the apparatus to cock the movable striker and prepare the apparatus for operation.

Referring now to FIGS. 1, 2 and 3 there is seen a ball toss sport training apparatus designated generally by reference numeral 10. In the illustrated embodiment the apparatus 10 is used to toss a baseball into the hitting zone of a batter. A baseball 12 is positioned at the upper open end of the training apparatus 10 where it is impacted by a moveable striker within the apparatus and directed upward into the hitting zone of a batter 14. The baseball 12 may be of any desired weight or size depending on the age and ability of the individual in training. Also, the ball toss sport training apparatus 10 can be used for training in other sports or athletic games such as volleyball or basketball, etc. to be described in greater detail herein below.

The novel construction of this invention will automatically create a negative pressure within an air chamber, and it is this negative pressure which holds the apparatus in a latched or cocked condition against the force of a spring. Throughout this description the terms "partial vacuum" and "negative pressure" are interchangeable and describe a relative pressure having a value less than ambient atmospheric pressure which is sufficient to hold the apparatus in a cocked state prior to impacting the baseball 12.

In one form of this invention the apparatus 10 includes a remote control transmitting device 15 for, sending a control signal to a receiver 16, which, in turn, operates a solenoid valve, to be more fully described herein below. Operation of the solenoid valve will actuate the apparatus by releasing the negative, pressure from within an air chamber substantially instantaneously, e.g., less than one second and propel the baseball upward. By using the remote control transmitting and receiving devices 15 and 16, more than one user can participate in the training exercise and an assistant or coach can operate the apparatus 10 while standing a safe distance from the hitting zone yet sufficiently near to give verbal instruction.

In another form of this invention the apparatus 10 is provided with a manually operated pneumatic timing device 18. The function of the pneumatic timing device 18 is to manually control the rate at which air enters an air chamber thereby controlling the time interval between the event of cocking the apparatus for use and the event of actuation of the apparatus for propelling the baseball 12 into the hitting zone of the batter 14. This feature allows the user to cock the apparatus, place a baseball on the upper open end and assume a proper-stance for hitting a baseball prior to the baseball being propelled into the hitting zone. This feature, e.g., the manually operated pneumatic timing device, also allows a single user to enjoy the full benefit of the training apparatus without the aid of a helper. The pneumatic timing device 18 is herein illustrated as a tapered needle valve assembly to provide an air-bleed path for reducing the negative pressure which holds the apparatus in a cocked state.

As best seen in FIG. 2, operation of the apparatus 10 propels the baseball 12 upward at selected angles for simulating either inside or outside pitches within the hitting zone of the batter 14. This feature is particularly useful for teaching the technique of hitting a baseball in different locations over home plate. As seen in phantom line, the batter must adjust his or her arms and hands to change the arc of the baseball bat 20 to insure proper contact between the bat and the baseball. After the batter 14 has completed the swing, the batter can quickly and easily reset or cock the apparatus 10 by using the baseball bat 20. As seen in FIG. 3, this is accomplished by placing an end 22 of the bat 20 in an opening at the top of the apparatus 10 and, by pushing down, move a ball striking element within the apparatus to a cocked position.

Figure 4:
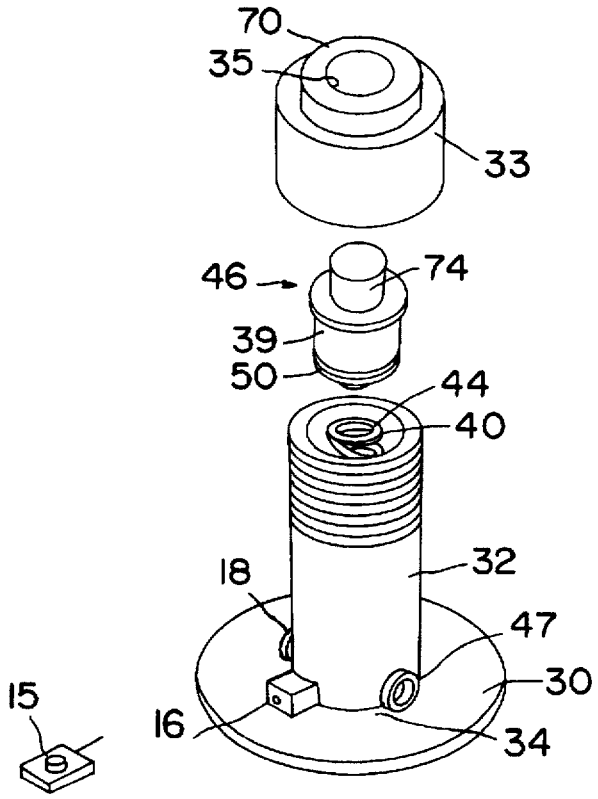
FIG. 4 is an exploded perspective view of the ball toss sport training apparatus of this invention illustrating the details of construction and the minimum number of components needed for operate the apparatus.
Figure 5:
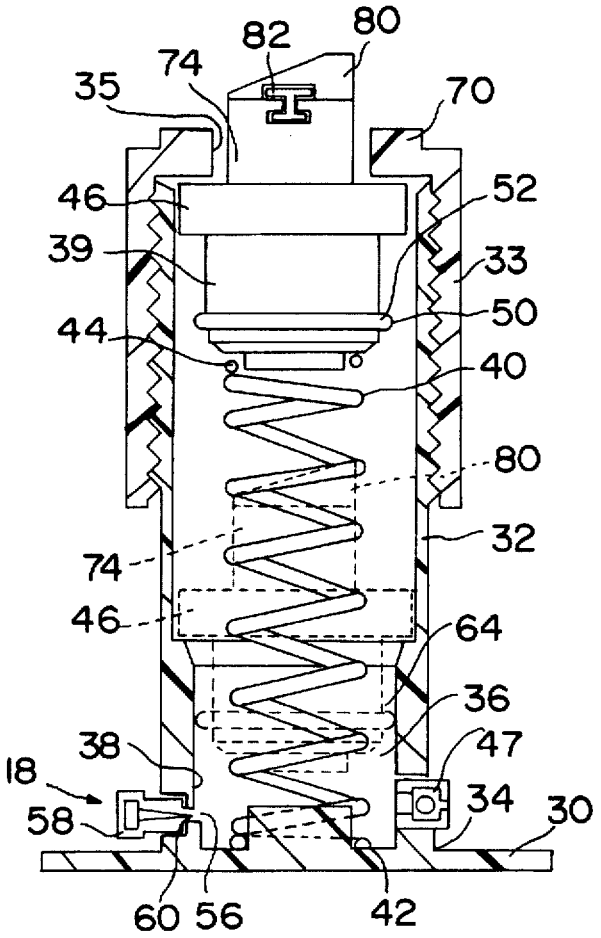
FIG. 5 is a sectional view of the ball toss sport training apparatus of this invention illustrating one form of pneumatic device for controlling the time interval between cocking the striker and actuation of the striker, and further illustrates in phantom lines, the apparatus in a cocked position ready for actuation to propel a baseball into the air.

Referring now to FIGS. 4 and 5 there are seen a perspective exploded view and a sectional view, respectively, showing details of the major components of this invention. The novel concept of the present invention is readily appreciated by noting the simplicity of design and the minimum number of components required for operation of the apparatus. The training apparatus 10 includes a base 30 and a rigid wall tube 32 having one end thereof secured to the base 30 at 34 and extends upward therefrom to receive the baseball 12. The upper open end of the rigid wall tube 32 receives a threaded adjusting cap 33 having an aperture 35 formed therein. The aperture 35 has an open dimension of between 1.25 inches and 3.5 inches in diameter. Therefore, the aperture 35 is large enough to receive the end 22 of the bat 20 for cocking the apparatus while being small enough to support the baseball 12. When the threaded cap 33 is turned fully down the apparatus is set for minimum travel height of the baseball. To increase the travel height of the baseball the cap is raised.

In accordance with a novel feature of this invention, a negative pressure is automatically created in an air chamber 36 for holding the apparatus 10 in a cocked condition. The air chamber 36 can be of any suitable diameter but preferably in the range of one half inch to four inches, and can have any suitable depth but preferably in the range of one to six inches. It will be understood that other dimensions may be used without departing from the novel concepts of this invention. The air chamber 36 is formed by two separate but cooperating elements. A first element of the air chamber 36 is a cylinder 38 which is secured to the base 30 or secured to the lower end of the rigid tube 32 either by pins, screws or adhesive, or by being machined as part of the tube 32. A second element of the air chamber 36 is formed by a piston 39 when it is inserted into the cylinder 38. The piston 39 may be formed integral with a ball striker or may be a separate element connected to the striker through suitable linkage.

A helical compression spring 40 is positioned within the rigid wall tube 32 and has a lower end 42 engaging the base 30 through the cylinder 38. The spring 40 has an upper end 44 engaging the bottom of the piston 39 for urging it and the striker toward the baseball 14. The spring 40 remains partially compressed when the striker is in the full up position and with the adjusting cap 33 at the maximum adjustable height. The piston 39 extends from the striker 46 in coaxial relation to the cylinder 38 for insertion therein, thereby forming the air chamber 36. As the piston 39 moves into the cylinder 38, the volume of the air chamber 36 decreases and air escapes through a check valve 47. When the piston 39 is fully inserted into the cylinder 38 the air chamber 36 will be at minimum volume. The striker is released and is urged upward a short distance by the spring 40 which, in turn, will urge the piston 39 a short distance toward disengagement from the cylinder 38 thereby causing a slight increase of the minimum volume of the air chamber 36. This action will close the check valve 47 and automatically create a partial vacuum within the air chamber 36. The partial vacuum thus created is sufficient to overcome the force of spring 40 and hold the spring, piston and striker 46 in a cocked state. As air enters the air chamber 36 through the pneumatic control timing device 18, the volume of the air chamber increases as the piston 39 is urged out of the cylinder 38. The piston 39 continues to withdraw until the force of the spring 40 is greater than the remaining partial vacuum within the air chamber 36, at which time the spring 40 is actuated to propel the ball into the air. While the cylinder 38 and piston 39 are shown axially aligned within the rigid wall tube 32, it is understood that these components may be eccentric within the tube or located remotely therefrom. It is further understood that the piston 39 may be formed as part of the base 30 or tube 32, while the cylinder 38 may be formed as part of the striker 46.

In the illustrated embodiment, an O-ring 50 is mounted on the piston 39 and held in place by means of a grove 52. The grove 52 has a diameter which is several thousandths of an inch larger than the minor diameter of the O-ring 50, and the cylinder 38 has a diameter which is several thousandths of an inch smaller than the major diameter of the O-ring 50. The relationship between the dimensions of the grove 52, O-ring 50 and cylinder 38 provide an airtight seal between the piston 39 and the cylinder 38 without causing undue friction resistance between the piston 39 and the cylinder 38. The check-valve 47 allows air to easily flow from the air chamber 36 thereby eliminating any resistance against the piston 39 as it enters the, cylinder 38. Only a small fraction of the air will pass in reverse direction through the pneumatic timing device.

As best seen in FIG. 5, the manual pneumatic control timing device 18 is in fluid communication with an orifice 56 which opens into the air chamber 36. The pneumatic control timing device 18 is herein illustrated as a needle valve assemble 58 which includes a tapered needle and seat 60. The tapered needle and seat 60, when fully closed, provide an air tight seal with the air chamber 36. The degree of taper of the needle valve and the number of threads per unit length of the needle valve assembly are selected to provide a variable pneumatic control time delay of between zero seconds and thirty seconds. After inserting the piston 39 into the cylinder 38, the striker 46 is released and the spring 40 is held in a cocked state by the partial vacuum developed in the air chamber 36. A small amount of air passes through the timing device 18 to cause slow upward movement of the striker 46 and piston 39 while the spring 40 continues to be held in the cocked state. This upward movement of the piston 39 occurs through a region of restrained travel, defined by the axial length of the cylinder 38, as air slowly enters the air chamber 36 through the orifice 56. The check valve 47 is fully closed at this time. When the O-ring 50 travels upward beyond the edge 64 at the upper end of the cylinder 38, the air chamber 36 is eliminated and the spring 40 is actuated to moves the striker upward through a region of rapid free travel to impact the baseball.

Figure 5A:
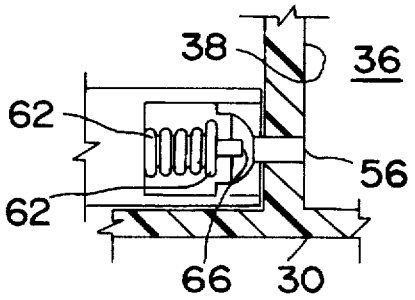
FIG. 5A is a partial sectional view of FIG. 5 showing an alternate form of pneumatic release control using a solenoid valve operated by the remote controlled means illustrated in FIGS. 1 and 2.

As shown in FIG. 5A the manual timing device 18 is replaced with a remote controlled solenoid valve 62 which functions as an instantaneous pneumatic release for the apparatus 10. The solenoid valve 62 includes a disc 64 mounted to a valve stem 66 and is arranged to fully close the orifice 56 whenever the solenoid is not energized. In this form of the invention the air chamber 36 is completely sealed by the disc 64, the check valve 47 and O-ring 50 and the striker will stay cocked substantially indefinitely. Operation of the transmitter 15 and receiver 16 will energize the solenoid valve 62 to open the orifice 56 and release the partial vacuum within the air-chamber through the orifice 56. While only one orifice 56 is illustrated, it will be understood that more than one orifice may be used, one for the manual pneumatic control time delay 18 and one for the remote control actuated solenoid valve 62, thereby providing both forms of the invention in a single apparatus.

The threaded adjusting cap 33 is axially movable relative to the rigid wall tube 32 to effectively change the length of the tube 32. The adjusting cap 33 has a radially inward retainer flange 70 which defines the aperture 35 for receiving and supporting the baseball 12. The striker 46 has a reduced diameter portion 74 for extension through the aperture 35 to impact the baseball 12. The striker 46 also has a main body portion 75 which engages the retainer flange 70 to stop movement of the striker. The retainer flange 70 limits the travel distance of the striker 46 as well as maintaining the apparatus in assembled condition. When the adjusting cap 33 is moved upward the distance traveled by the striker is increased, and the baseball is impacted with increased force to travel higher into the air. Moving the cap 33 downward will reduce the height of travel of the baseball.

Removably secured to the impact portion 74 of the striker 46 is a wedge shaped member 80 which is used to change the point of impact between the striker and the baseball and thereby propel the baseball 12 upward at a selected angle for simulating either an inside or an outside pitch. In the illustrated embodiment the wedge member 80 is secured to the striker 46 by means of a screw 82. It will be understood that any suitable means may be used to secure the wedge member to the striker, as well as forming the wedge member as an integral part of the striker 46.

Figure 6:
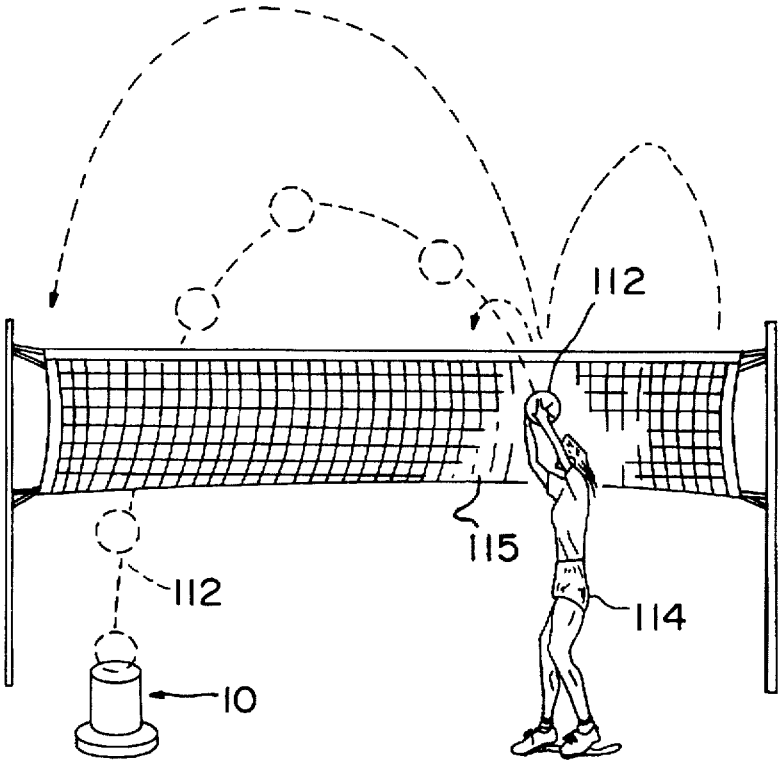
FIG. 6 illustrates the ball toss sport training apparatus of this invention used for the sport of volleyball; and, FIG. 7 illustrates the ball toss sport training apparatus of this invention used for the sport of basketball.

Referring to FIG. 6 the ball toss sport training apparatus 10 is illustrated for use in the sport of volleyball. In this environment the apparatus 10 receives a volleyball 112, as shown in phantom line, for projection in the region of a volleyball player 114. The apparatus 10 allows a single player 114 to practice a variety of technique of hitting the volleyball over a net 115. The player 114 can practice a normal volley return over the net, as seen in FIG. 6, or the player 114 can practice jumping as high as possible and hitting the volleyball 112 in a predominantly downward direction over a net 115. This technique is commonly known as spiking the ball. Volleyball teams with players that can successfully spike the ball over the net are most likely to win the game. With the apparatus of this invention an individual can practiced this important technique without the aid of other teammates.

Figure 7:
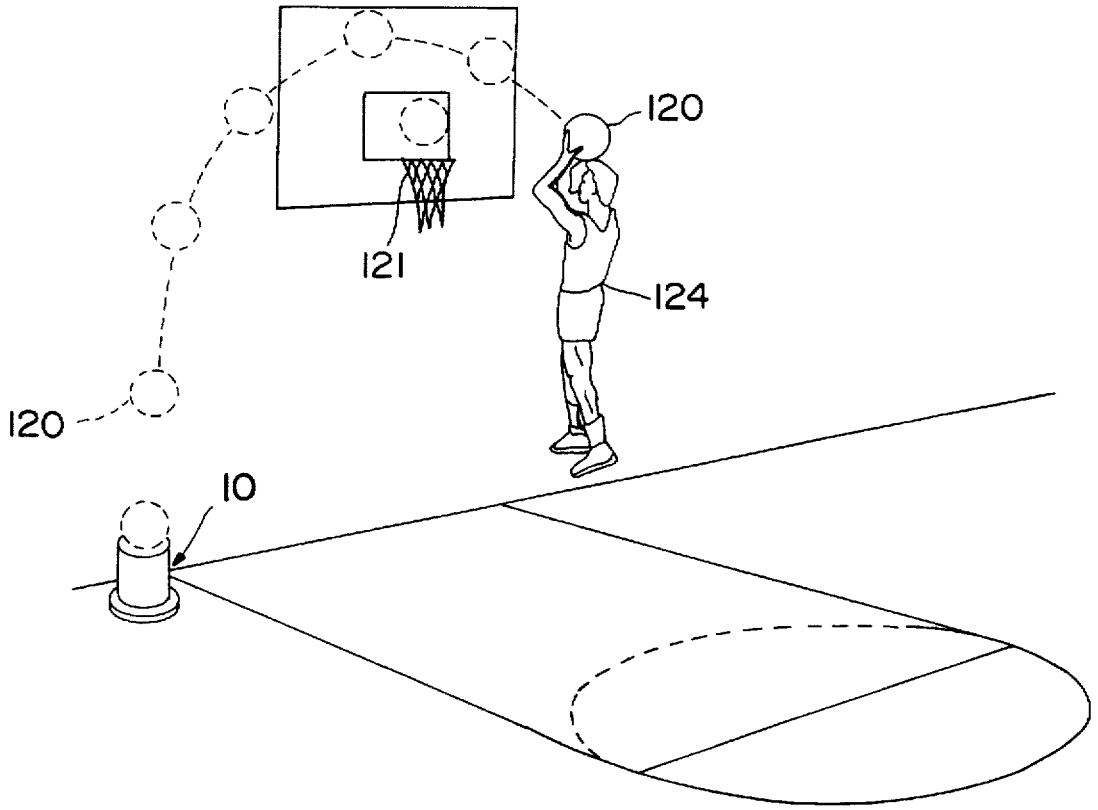

Referring now to FIG. 7 the ball toss sport training apparatus 10 is illustrated for use in the sport of basketball. In this environment the apparatus 10 receives a basketball 120, shown in phantom line, for projecting the basketball into the air near a basketball hoop 121. A basketball player 124 can use the apparatus 10 to practice the technique of jumping as high as possible to catch the ball 120 near the hoop 121 and, while the player 124 is still in the air, put the basketball into the hoop 121. The ball toss apparatus of this invention can project larger and heaver balls a higher distance, as required for volleyball and basketball use, by increasing the strength and or stiffness of the helical compression spring 40.

Accordingly, the present invention, as disclosed herein, provides a novel ball toss sport training apparatus for use in a variety of ball sports, which apparatus has a minimum of moving parts, which is inexpensive to manufacture, and which is easy to disassemble and assemble for maintenance. It will be understood that specific details and characteristics as set forth in the specification and as shown on the drawings may vary without departing from the spirit and scope of the novel concepts of my invention.

What I claim is:

1. A sport training apparatus for projecting a ball into the air, comprising;

a base, ball projecting means mounted to said base for supporting and projecting said ball upward from said base, spring means connected to said base and to said ball projecting means, said spring means operable between a cocked state and an actuated state, first means connected to said base forming a first portion of an air chamber when said spring means is in said cocked state, second means connected to said ball projecting means and in axial alignment with said first means forming a second portion of said air chamber when said spring means is in said cocked state, said air chamber having a negative pressure formed therein for holding said spring means in said cocked state, check valve means in fluid communication with said air chamber for providing an unrestricted exit air path from said air chamber as said first means engages said second means and for closing said exit air path from said air chamber for cocking said spring means, and pneumatic control release means in fluid communication with said air chamber for releasing at least a portion of said negative pressure from said air chamber thereby releasing said spring means from said cocked state to said actuated state and actuating said ball projecting means to propel said ball from said sport training apparatus.

2. The sport training apparatus as set forth in claim 1, wherein said pneumatic control release means includes an adjustable needle valve for controlling the rate of air flow into said air chamber thereby varying a time interval between (a) moving said first means into engagement with said second means for holding said spring in said cocked position and (b) disengagement of said first means from said second means to release said spring means from said actuated state.

3. The sport training apparatus as set forth in claim 1, wherein said pneumatic control release means including remote controlled means comprising, transmitter means for sending a signal, receiver means for receiving said signal, a solenoid valve operatively connected to said receiver means for energization therefrom when said signal is received, and means connected to said solenoid valve and to said pneumatic control release means for operation of said pneumatic control release means in response to operation of said transmitter means for substantially instantaneous release of said spring means.

4. The sport training apparatus as set forth in claim 1, further including means for directing said ball upward at a selected angle from said ball projecting means.

5. The sport training apparatus as set forth in claim 1, wherein said ball projecting means includes a retainer cap axially movable relative to said tube and having an aperture formed therein for receiving said ball whereby, axial movement of said retainer cap relative to said spring means selects the height traveled by said ball.

6. The sport training apparatus as set forth in claim 1, wherein said first means is a piston formed integral with and extends axially from said ball projecting means for movement therewith, and said second means is a cylinder secured to and projecting from said base in axial alignment with said piston for receiving said piston and forming said air chamber.

7. The sport training apparatus as set forth in claim 6, wherein said piston includes an annular grove, and an O-ring mounted in said grove forming an airtight seal between said piston and said cylinder.

8. The sport training apparatus as set forth in claim 6 wherein said spring means is a helical compression spring having one end thereof inserted into said cylinder and the other end thereof engaging said piston, and said helical compression spring is positioned into said air chamber when in said cocked state.

9. An apparatus for presenting a baseball within the hitting zone of a batter holding a baseball bat, comprising:

a base;

a tube extending upwardly from the base and having an open end opposite the base to receive a baseball;

spring means positioned within the tube adjacent a movable striker, the spring means being actuable from a cocked state when said striker is in a lowered position within said tube;

a lower portion of said tube forming a chamber, a piston having a ball striker being movable within said tube, means on said piston engagable with said chamber whereby upward movement of said piston causes air pressure within the chamber sufficient to overcome the force of the spring means to hold the spring means in a cocked state; and means for selectively releasing at least a portion of the negative pressure within said chamber to actuate the spring from said cocked state and to cause the striker to move upward and impact the baseball with sufficient force to propel the baseball into the hitting zone of the batter.

10. The apparatus of claim 9, wherein the releasing means comprises pneumatic timing means including a tapered needle.

11. The apparatus of claim 9, further comprising a deflection plate positionable on the movable striker to induce the baseball to travel at an angle from vertical.

12. The apparatus of claim 9, further comprising remote control means operatively associated with the chamber for actuating the releasing means from a remote location.

13. An apparatus for presenting a baseball within the hitting zone of a batter holding a baseball bat, comprising:

a base, a tube extending from said base and having an open end opposite said base to support a baseball, spring means positioned within said tube, a movable striker within said tube and adjacent said open end for movement against said spring means by inserting one end of said baseball bat into said open end and pushing said baseball bat against said striker for compressing said spring means to move said striker into a cocked position, first and second means for holding said striker in said cocked position, said first means being connected to said striker for movement therewith and forming a first portion of an air chamber, said second means being within said tube for receiving said first means and forming a second portion of said air chamber when said striker is moved to said cocked position, check valve means in fluid communication with said air chamber for providing an exit for air within said air chamber as said first means engages said second means and for sealing said air chamber as said first means is urged out of engagement from said second means by said spring means thereby forming negative pressure within said air chamber sufficient to counteract the force of said spring means to hold said striker in said cocked position, and pneumatic control release means in fluid communication with said air chamber for controlling the rate air enters said air chamber and releasing said first means from said second means by the force of said spring means, thereby releasing said striker from said cocked position for impingement with said baseball to propel said baseball into the hitting zone of a batter.

14. The apparatus as set forth in claim 13, wherein said pneumatic control release means is a manually adjustable needle valve for selecting the rate of air flow into said air chamber to release said negative pressure over a selected time interval.

15. An apparatus as set forth in claim 13, further including remote control means comprising, transmitter means for sending a signal, receiver means for receiving said signal, a solenoid valve operatively connected to said receiver means for energization therefrom when said signal is received, and means connecting said solenoid valve to said pneumatic control release means for operation thereof in response to energization of said transmitter means to release said negative pressure within said air chamber for substantially instantaneous release of said striker.

16. An apparatus as set forth in claim 13, wherein said first means is a piston formed integral with said striker and extends coaxially therefrom for direct movement therewith, and said second means is a lower portion of said tube having an internal transverse dimension less than the remaining internal transverse dimension of said tube and in coaxial alignment with said piston for receiving said piston and forming said air chamber.

17. An apparatus as set forth in claim 13, wherein said open end of said tube has an internal diameter greater than 1.25 inches and less than 3.5 inches to receive one end of said baseball bat for urging said first means into engagement with said second means.

18. An apparatus as set forth in claim 13, further including impact means secured to said striker for changing the point of impact between said striker and said baseball, thereby propelling said baseball upward at an angle within the hitting zone of the batter for simulating either an inside or an outside pitch.

19. An apparatus as set forth in claim 13, wherein said first means is a piston having an annular grove, an O-ring position within said grove, said second means is a lower portion of said tube having an internal transverse dimension less than the remaining internal transverse dimension for receiving said piston and said O-ring during cocking of said striker, said O-ring forming an airtight seal between said piston and said lower portion to form said air chamber.

20. An apparatus as set forth in claim 19, wherein said spring means is a helical compression spring having one end inserted into said lower portion and the other end engaged with said piston.

* * * * *